United States Patent [19]

Scaletta

[11] 4,107,633

[45] Aug. 15, 1978

[54] BROADBAND MICROWAVE CARD ATTENUATOR

[75] Inventor: Ronald C. Scaletta, Gaithersburg, Md.

[73] Assignee: Weinschel Engineering Co., Gaithersburg, Md.

[21] Appl. No.: 744,897

[22] Filed: Nov. 24, 1976

[51] Int. Cl.[2] ..... H01P 1/22

[52] U.S. Cl. ..... 333/81 A; 333/81 R

[58] Field of Search ..... 333/81 A, 81 R

[56] References Cited

U.S. PATENT DOCUMENTS

| | | | |
|---|---|---|---|
| 3,217,276 | 11/1965 | Cooper et al. | 333/81 |
| 3,260,971 | 7/1966 | Bacher et al. | 333/81 A |
| 3,622,919 | 11/1971 | Wilhoit | 333/81 |
| 4,001,736 | 1/1977 | Malcolm et al. | 333/81 A |
| 4,011,531 | 3/1977 | Gaudet | 333/81 A |

FOREIGN PATENT DOCUMENTS

| | | | |
|---|---|---|---|
| 1,300,615 | 12/1972 | United Kingdom | 333/81 A |

*Primary Examiner*—Alfred E. Smith
*Assistant Examiner*—Harry E. Barlow
*Attorney, Agent, or Firm*—William D. Hall; Geoffrey R. Myers

[57] ABSTRACT

The invention relates to a card-type attenuator having a flat insertion loss from DC to 2 GHz or higher. A rectangular card has two ground conductors extending along its longitudinal side edges and an inner conductor extending along a first face of the card midway between said ground conductors. The outer conductor comprises two main parts: First, a metal trough into which the card is placed with the two ground conductors, and secondly, an inverted U-shaped metallic spring which has its free ends pressing against the ground conductors respectively to hold them firmly in the trough. The inner conductor is accurately positioned a distance from the bottom of the trough which is small compared to the distance that the U-shaped spring is above the inner conductor. Hence, most of the electromagnetic field exists between the inner conductor and the bottom of the trough. Accordingly, the exact size and shape of the U-shaped spring is not critical. The card has resistive layers of width many times smaller than the length of the card respectively adjacent the two ends of the card. Each such layer extends from the inner conductor to the ground conductor. A plurality of said card attenuators are used to form a drum attenuator. A special spring contact connects such card to the output switch of the drum attenuator.

60 Claims, 23 Drawing Figures

FIG. 5
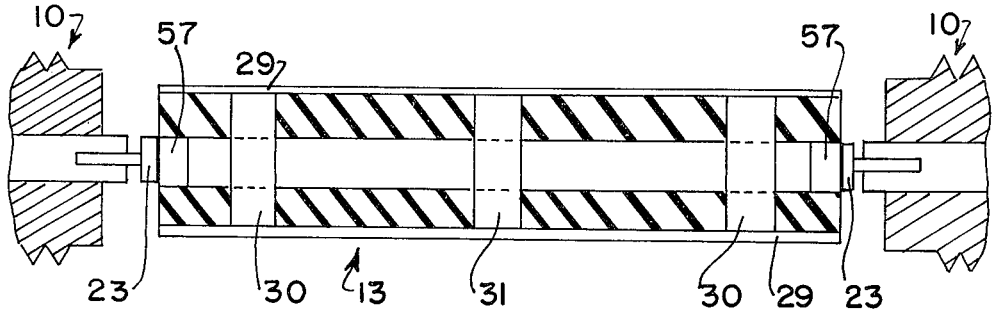
FIG. 12
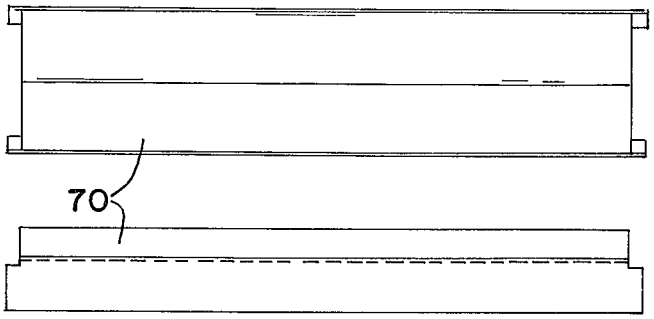
FIG. 13
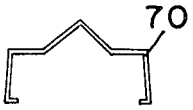
FIG. 14
FIG. 16
FIG. 15
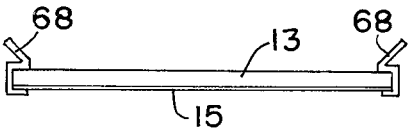
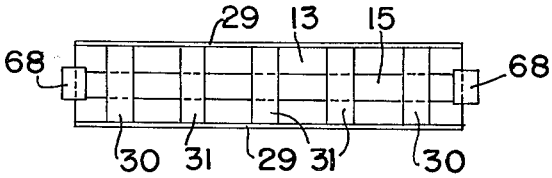
FIG. 17
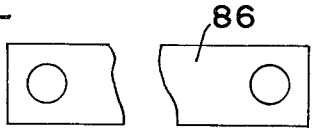
FIG. 18
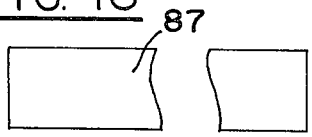
FIG. 19
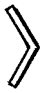
FIG. 20
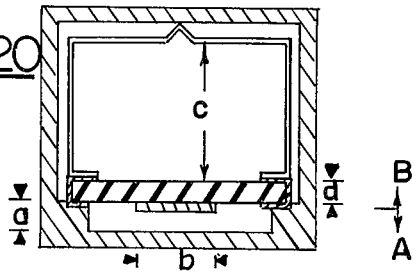

FIG. 10
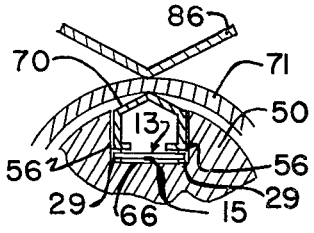
FIG. 6
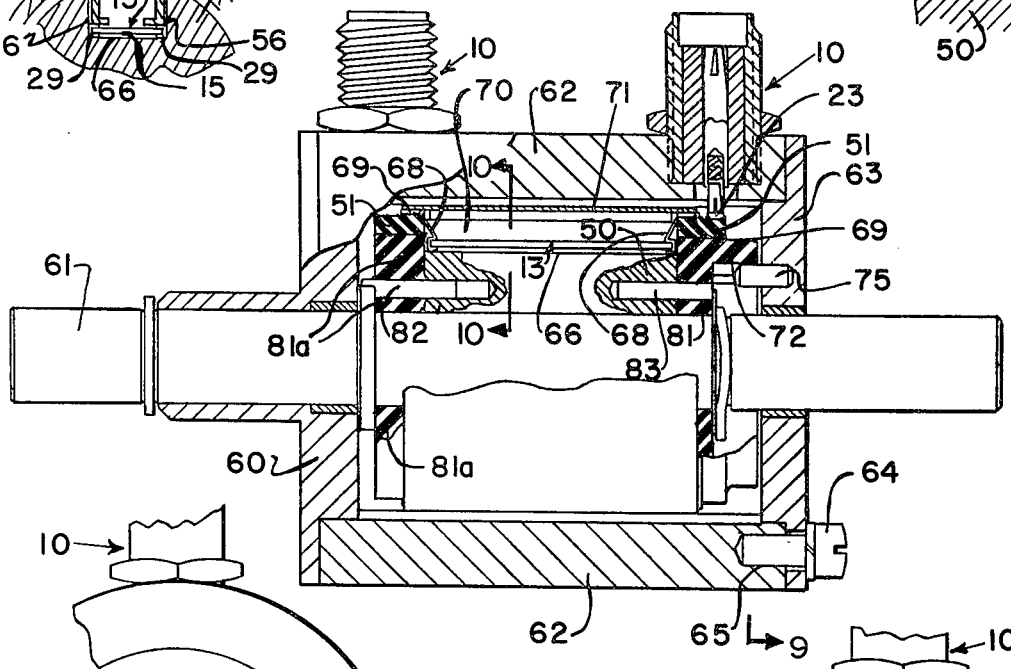
FIG. 11
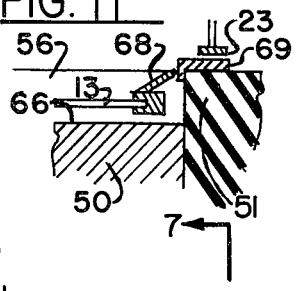
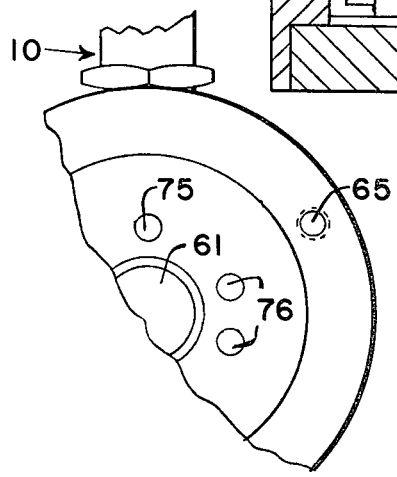
FIG. 9
FIG. 8
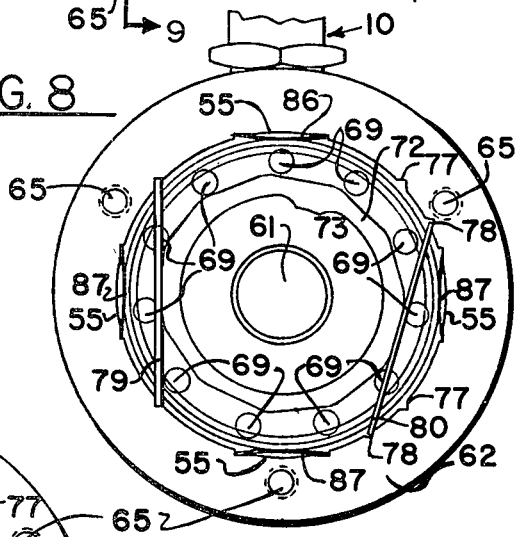
FIG. 7
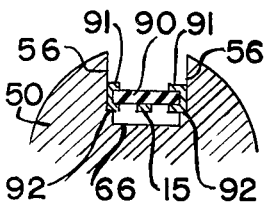
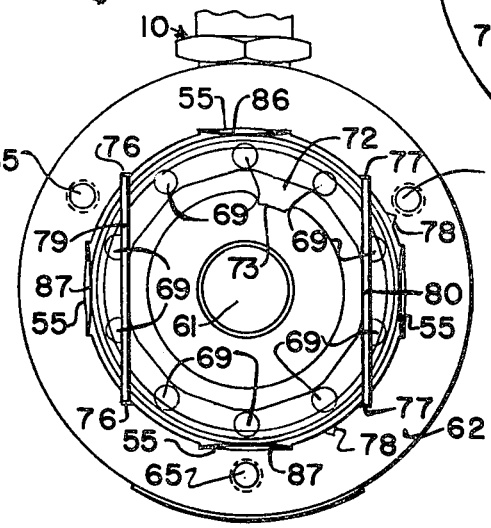
FIG. 21
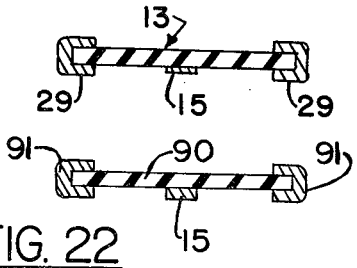
FIG. 23
FIG. 22

BROADBAND MICROWAVE CARD ATTENUATOR

BACKGROUND OF THE INVENTION

Card attenuators are old and well known, see U.S. Patents:

U.S. Pat. No. 3,521,201, Veteran, July 21, 1970
U.S. Pat. No. 3,260,971, Bacher et al., July 12, 1966
U.S. Pat. No. 3,227,975, Hewlett et al., Jan. 4, 1966
U.S. Pat. No. 3,157,846, Weinschel, Nov. 17, 1964

It is also desirable to have attenuators in which any of a wide range of attenuation values may be selected and, therefore, drum-type attenuators have been developed, see U.S. Pat. No. 3,157,846. See also U.S. Pat. No. 3,805,209, to Keranan, issued Apr. 16, 1974.

The prior attenuators are expensive to construct. For example, in connection with the aforesaid U.S. Pat. Nos. 3,157,846 and 3,227,975, the characteristic impedance is determined by the shape and dimensions of the cross-sections of the inner and outer conductors, as well as by the dimensions and dielectric constant of the card. Therefore, it is necessary to employ close fabrication tolerances in the construction of all of the aforesaid parts of those attenuators. In addition, it is necessary that the outer conductor must provide full shielding to the outside world, especially for the higher dB values of attenuation, must have a shape as required for the desired characteristic impedance, and must provide a high conductive connection to the resistive film on the card. Hence, manufacture of the outer conductor is quite expensive. Indeed, it is customary to use machined metal parts for the outer conductor as well as for many other parts of the attenuator.

Furthermore, when it is desired to have a step or drum attenuator, that is one which is adjustable to different values of attenuation, many problems arise because it is not only necessary to provide accurate tolerances to all parts when the attenuator is first constructed, but it is necessary that the design be such that the relation of the various parts of the attenuator be accurately maintained throughout the life of the attenuator.

A main object of the invention is to provide a card-type attenuator which overcomes the aforesaid disadvantages.

Another object is to provide a card-type attenuator that may be incorporated in a step or drum type device and which will maintain its accuracy notwithstanding the forces arising from time to time due to switching from one degree of attenuation to another. Still other objects relate to providing improved cards for card-type attenuators.

A further object of the invention is the provision of an attenuator with a reduced requirement for machined parts.

An important object of the invention is to provide a low cost broadband attenuator.

Other objects and advantages of this invention will appear as this description proceeds.

SUMMARY OF THE INVENTION

A card is provided for a card-type attenuator in which the inner conductor extends along the card typically midway between its longitudinal side edges. Ground conductors may be placed along one or both longitudinal side edges. The ground conductors may be thicker than the inner conductors so that when the card is placed upon a flat surface, the inner conductor is spaced above said surface. The outer conductor includes a metal trough. The card rests upon the bottom face of the trough with the ground conductors in good contact with the trough. The inner conductor is spaced above the bottom face of the trough but is positioned close thereto preferably in order to maintain a low VSWR. Alternatively, the outer conductors may rest on ledges in the side wall of the trough to accurately space the inner conductor from the bottom wall of the trough. The outer conductor is completed by a metal inverted U-shaped spring located above the ground conductors, the cross-arm of the U pressing against an element which is fixed with reference to the position of the trough so that the free arms of the U press the ground conductors firmly against the bottom side of the trough. As a result, the electric field is highly concentrated in the space between the inner conductor and the bottom of the trough, and it is unnecessary to maintain accuracy in connection with the tolerances involving (a) the thickness of the card, (b) its dielectric constant and (c) the size of the U-shaped spring. A number of the aforesaid cards may be mounted on a rotatable drum to provide a step attenuator. In that case, the troughs comprise longitudinal grooves along a cylindrical metal drum, said grooves being parallel to the axis of the drum. A ring concentric with and outside the drum constitutes the element which is fixed with reference to the position of the trough to thus press the U-shaped springs against the ground conductors to in turn press them against the bottom of the trough.

The inner conductor is located on that face of the card which is closest to said bottom although at each lateral end of the card the inner conductor extends around that end and has a short section on the other face of the card, and it then extends transversely away from the card at an acute angle to said short section to provide a contact spring. The two contact springs at the opposite ends of the cards respectively engage contact strips maintained in fixed position with respect to the drum and constitute switching contacts to connect the inner conductors of the coaxial lines which enter the drum-attenuator. The outer conductor in the case of each card-attenuator comprises the aforesaid trough, spring, ring, and drum.

Resistive layers are on the face of the card closest to said bottom and are preferably located adjacent the two lateral ends of the card. They extend from the inner to the ground conductor or conductors. Additional resistance layers may be added between the above mentioned layers in event additional attenuation is desired.

BRIEF DESCRIPTION OF THE DRAWINGS

In the drawings.

FIG. 1 is a cross-sectional view of FIG. 2, taken along line 1—1 of FIG. 2.

FIG. 5 is a bottom view of the card of FIG. 4. This view shows how the inner conductor of the input and output may engage the inner conductor of the card.

FIG. 6 is a cross-sectional view of a drum-type step attenuator embodying the invention.

FIG. 7 is a right end view of FIG. 6, with the right hand cover plate 63 (together with bolt 64) removed; it being noted that this end view is one of an attenuator having ten cards.

FIG. 8 is an end view similar to FIG. 7 except for an attenuator having eleven cards.

FIG. 9 is a view taken along lines 9—9 of FIG. 6 and shows mainly the end plate 63 together with pin 75, shaft 61 and other details.

FIG. 10 is a sectional view taken along lines 10—10 of FIG. 6 and shows the construction of an individual attenuator.

FIG. 11 shows a detailed view of how one end of the inner conductor of an attenuator is connected to the stationary switch contact 69 for engagement by contact point 23 of the input (or output) coaxial connector.

FIG. 12 is a top view of the inverted U-shaped spring which forms a part of the outer conductor.

FIG. 13 is an end view of the aforesaid U-shaped spring.

FIG. 14 is a side view of the aforesaid U-shaped spring.

FIG. 15 is a longitudinal cross-sectional view of the card showing the contact strips for connecting the inner conductor 15 to stationary contact strips 89.

FIG. 16 is a bottom view of the card of FIG. 15.

FIG. 17 is a top view of spring 86 employed in connection with the invention.

FIG. 18 is a top view of springs 87 employed in connection with the invention.

FIG. 19 is an end view of the spring shown in FIG. 18, it being noted that this is also an end view of the spring shown in FIG. 17.

FIG. 20 is a cross-section of the typical implementation of the invention for the purpose of explaining the mathematical aspects thereof.

FIG. 21 is a lateral cross-sectional view of the card of the attenuator of FIG. 6, with the contact springs 68 omitted.

FIG. 22 is a cross-sectional view of the preferred form of card for use in the card attenuator.

FIG. 23 is a cross-sectional view of the preferred shape of the trough in drum 50, utilizing the preferred form of card shown in FIG. 8.

DETAILED DESCRIPTION OF THE DRAWINGS

Figure 1:
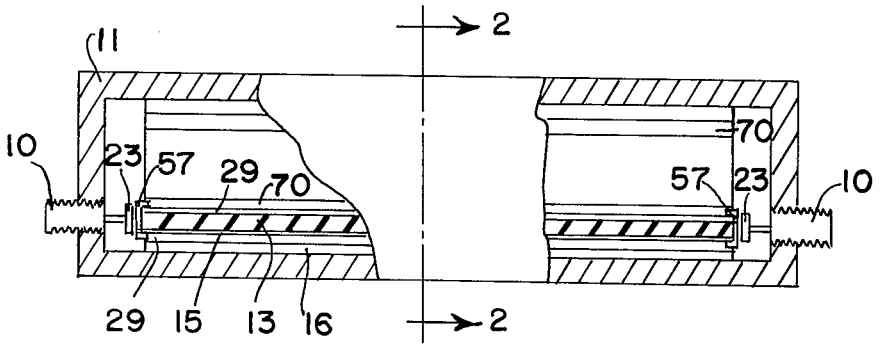
FIG. 1 is a cross-sectional view of a card-type attenuator embodying the broader aspects of the invention.
Figure 2:
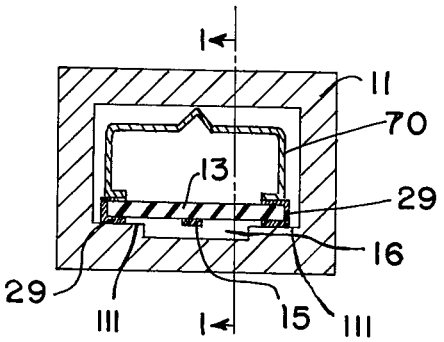
FIG. 2 is a cross-sectional view of the attenuator of FIG. 1 taken along the line 2—2 of FIG. 1. Similarly.
Figure 4:
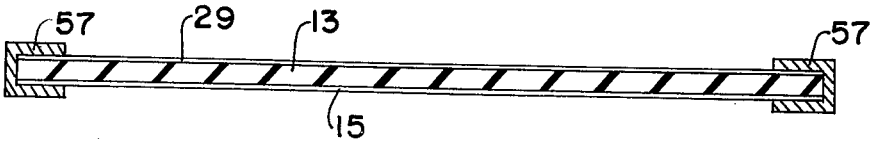
FIG. 4 is an enlarged cross-sectional view of that portion of FIG. 1 which shows the card.

A simple card-type attenuator conforming to the invention is illustrated in FIGS. 1 and 2 wherein a sheet of insulating material 13 has ground conductors 29 along opposite longitudinal edges thereof. An inner conductor 15 runs along the bottom face of the card 13 and has resistive layers 30 extending between the inner conductor 15 and the ground conductors 29 as shown in FIG. 5. The ground conductors 29 are pressed against the bottom inner wall of metal housing 11, by an elongated spring 70 of U-shaped cross-section, see FIGS. 1, 2 and 12 to 14. Each of the two contact points 57 of the conductor 15 (FIG. 4) are engaged by the contact point 23 of the inner conductor of the coaxial input (or output) transmission line (FIG. 5). The coaxial input (or output) connectors 10 have outside threads 20 which mate with threads in the housing 11 to thereby connect the outer conductors 10 to the housing 11. The inner conductor of each connector 10 has a receiving socket 24 for receiving the inner conductor of a coaxial transmission line. This socket 24 is connected to a tube 19 which contains a spring 21 that presses plunger 22 outwardly which in turn presses contact point 23 outwardly to insure good contact with inner conductor 15.

The ground conductors 29 accurately space the card 13 and the inner conductor 15 from the bottom of the cavity 16 in casing 11. The accurate spacing is maintained by the constant pressure of the inverted U-shaped spring 70 which has the cross-arm portion of the U pressing against the upper inner wall of casing 11 and the two free ends of the legs of the U pressing against the ground conductors 29 respectively to hold the ground conductors 29 firmly against the ledges 111 of inner wall of metal casing 11. The result is that the inner conductor is closely spaced from the bottom wall of metal housing 11. In contrast, there is a relatively wide spacing between the inner conductor and the spring 70. It follows that the electromagnetic field is heavily concentrated between the relatively closely spaced inner conductor 15 and the bottom wall of casing 11, whereas there is only a weak field between the inner conductor 15 and the spring 70. Therefore, the tolerances and shape of the spring 70 are not critical. Similarly, since the inner conductor 15 is mounted on the bottom face of the card 13, the thickness of the card and its dielectric constant are not critical. Consequently, by accurately preserving the thickness of the ground conductors 29 and the shape of the bottom wall of casing 11, the broadband characteristics of the microwave attenuator may be preserved without the expense of maintaining accurate tolerances for the remainder of the component parts.

The advantages, obtained by the present invention, as just described can be demonstrated by calculating the effects of mechanical tolerances on the characteristic impedance of a lossless section.

FIG. 20 shows the cross section through a typical implementation of a transmission line on an unsymmetrical suspended substrate. Typical dimensions for a 50 ohm resistive characteristic impedance are $$b/a = 2.7,\ c/b = 2.10576,\ d/b = 0.304$$

if one uses a dielectric constant $\epsilon = 8.75$, which is typical of ceramic employed for such substrates. The characteristic impedance can be computed approximately by dividing the cross section into two parts A and B as shown.

As indicated by reference to Meinke/Gundlach, Taschenbuch der Hochfrequenztechnik, Springer Verlag 1956, pp. 174–177, the line impedance for the section A can be approximated by $$Z_A = 60 \ln 9 \frac{a}{b} = 60 \ln \frac{9}{2.7} = 72.24\ \Omega$$

The line impedance for the section can be approximated by $$Z_B = 60 \ln 7 \frac{c + \frac{d}{e}}{b} = 60 \ln 7 \left( \frac{c}{b} + \frac{d}{b\epsilon} \right) =$$

$$60 \ln 7 \left( 2.10576 + \frac{0.304}{8.75} \right) = 162.418$$

The composite impedance becomes $$Z_O = \frac{Z_A Z_B}{Z_A + Z_B} = 50.0\ \Omega$$

The electromagnetic energy contained in area A (the precision cut channel) in relation to the total energy is $$\frac{E_A}{E_A + E_B} = \frac{Z_O}{Z_A} = \frac{50}{72.24} = 0.692 = 69.2\%$$

while 30.8% is contained in section B—the spring type housing, demonstrating the effectiveness of the invention.

The claim that the performance of the attenuator is relatively insensitive to tolerances to the substrate and the spring is examined next. An increase of the dimension $c$ by 10% causes a change of impedance $Z_B$ to $$Z_B^1 = 60 \ln 7 \left( 2.10576 \cdot 1.1 + \frac{0.304}{8.75} \right) = 168.048$$

and the composite impedance becomes $$Z_O^1 = \frac{Z_A \cdot Z_B^1}{Z_A + Z_B^1} = 50.521\ \Omega$$

resulting in a change of 1.042% in the characteristic impedance of 50 ohms.

A change of the substrate dimension by 10% or a change of the dielectric constant by 10% will cause $Z_B$ to change to $$Z_B^{11} = 60 \ln 7 \left( 2.10576 + \frac{0.304}{8.75} 1.1 \right) = 162.512\ \Omega$$

and the composite line impedance becomes $$Z_O^{11} = \frac{Z_A \cdot Z_B^{11}}{Z_A + Z_B^{11}} = 50.00922\ \Omega$$

resulting in a change of 0.0185% in the characteristic impedance of 50 ohms.

These calculations show that even substantial dimensional changes of the spring cross section and the dielectric substrate have only negligible influences on the characteristic impedance of the attenuator.

It is noted that in FIG. 1 the outer conductor of the transmission line comprises the metal spring 70, the ground conductors 29, and that portion of the metal housing 11 which extends between the two ground conductors 29. Of course, the outer metal housing 11, around spring 70, may be considered part of the outer conductor in the sense that it will confine any stray field that happens to leak past the spring 70 or the ground conductors 29.

As a consequence, the outer conductor of the present invention serves its primary purpose of confining the electromagnetic field within the transmission line.

It also provides a shape as required for the prescribed characteristic impedance because of the relationship between the inner conductor 15 and the bottom wall of the metal housing 11 as described above. The present invention also provides a high conductive connection to the resistive film on the dielectric substrate of the card 13. The resistive layer may be in the form of strips perpendicular to the inner conductor 15, and are in the form of layers on the card and extend from the inner conductor 15 to one or both of the ground conductors 29. FIGS. 5 and 16 show the relationship of the card 13, the ground conductors 29, the inner conductor 15 and the resistive strips 30. As shown in FIGS. 5 and 16 the card is many times longer than its width, and also many times longer than the width of the resistive layers 30.

Preferably, when only one of the resistive strips 30 is required, it is located either centrally or adjacent one lateral end of the card if that end should have better V.S.W.R. When two resistive films are employed they should be located adjacent opposite ends of the card. When additional strips are required, they may be located between the two strips that are at opposite ends of the card, see for example, FIGS. 5 and 16.

By locating two of the resistive strips adjacent opposite ends of the card, as shown in FIGS. 5 and 16, a flat frequency response between DC and 26 GHz may be achieved, whereas where the resistance is equally distributed along the card, as set forth in aforesaid U.S. Pat. Nos. 3,157,846 and 3,227,975, there is a flat frequency response only for attenuation values up to 10 dB. In the present invention, flat frequency responses from DC to 26 GHz may be achieved for much higher values of dB, for example, 22 dB or higher. For example, in FIG. 5, the value of each of the two layers 30 adjacent the two opposite ends of the card may be 6 dB and the resistance value of the middle layer 31 may be 10 dB, giving a total resistance value for the entire card of 22 dB. The flat frequency response at such a high value of dB, and over the broadband indicated, is achieved because two of the three layers are concentrated at two opposite lateral edges of the card 13. If additional attenuation is desired, additional resistive layers 31 may be added as shown in FIG. 16. Alternatively, the attenuation values of the three layers 30, 31, of FIG. 5 may be increased.

By placing two of the resistive layers 30 close to the input and output lateral edges of the card, several desirable results are achieved. First, the inner conductor may be a printed conductor added to the card according to the prior art teachings of printed circuit techniques. Conductor 15 may, therefore, have minor variations and inaccuracies along the length. These inaccuracies become immaterial and have no effect upon the characteristic impedance of the attenuator card when the resistive films 30 are located adjacent opposite ends of the card. Moreover, it is desirable, in many cases, to have a number of cards representing different dB values. For example, as we will hereinafter see, a drum attenuator may be employed wherein there are, for example, 10 or 11 cards each with a different dB value. It is desirable that each card used with the drum attenuator be of equal length. This not only permits substitution of cards but simplifies the construction of the drum attenuator. The cards may be of equal length without the length having any undesirable effect upon the operation of the attenuator when the resistive films 30 are located adjacent the input and output ends of the card, and this is true even though the various card range from low to high dB values. Moreover, there is a phase shift in the microwave signal passing along the card. If all of the cards are of equal length, the insertion phase shift tends to be the same for each card.

The step attenuator described in FIG. 6 is designed to provide a constant broadband attenuation from DC to at least 2 GHz and preferably higher, for example, 4 GHz. While the resistive cards have a flat attenuation curve to at least 26 GHz, the size of the switching mechanism in FIG. 6 limits its accurate use to about 4 GHz. Such step attenuators are frequency used in various forms of measuring instruments and are provided with a plurality of cards, each providing a suitable attenuation value. The operator selects the desired attenuation value by rotating the shaft 61 to bring the desired one of the numerous cards into operating position.

The attenuator has a stationary main body comprising a left end body section 60 secured in fixed relation to a cylindrical body section 62. A right end plate 63 is detachably secured to the cylindrical section 62 by bolts 64 which mate with threaded holes 65 in section 62. Two coaxial connectors 10 have outside threads which mate with the threads in holes passing through section 62. A stationary pin 75 is carried by right end section 63. If desired the stationary pin may be placed in any one of many alternate positions 76. Springs 86 and 87, and resilient bars 79 and 80 are also stationary.

The rotatable parts of the attenuator comprise: shaft 61, drum 50, plastic polygon-shaped projection 72 with projection 73, attenuator card 13 with its associated inner conductor 15, spring contacts 68, contacts 69, U-shaped spring 70, annular ring 71, and pins 82 and 83 which hold the rotating parts together.

The main rotatable drum 50 has a plurality of longitudinal troughs or grooves 66–56 (FIG. 6) running longitudinally along its outer surface. One of these grooves is shown in FIG. 10 and has, in addition to the bottom wall 66 of the groove, two up-standing walls 56 so that the groove is in the shape of a trough running longitudinally along the drum and parallel to the axis of the attenuator. Each groove is provided with its own individual card attenuator 13 which has an inner conductor 15 running along the card midway between its longitudinal edges. Each end of the inner conductor 15 has a spring contact 68 which engages a contact strip 69 mounted on the sleeve 51 (of insulating material) which is carried by the drum 50 adjacent to the end of the groove 66–56.

These are two sleeves 51 carried by the drum 50, one adjacent to the right hand ends of the grooves 66–56, and the other carried adjacent the left hand ends of the grooves.

Each of the two coaxial connectors 10 have a spring pressed contact arm 23 on its inner conductor which arm 23 engages its complementary contact strip 69. The attenuator of FIG. 6 has 10 cards 13. Each time the drum is rotated one-tenth of a revolution, another card 13 is brought into the top position and their contact strips 69 engage their respective contact arms 23 to complete the circuit.

The card 13 has ground conductors 29 along each longitudinal edge of the card. These ground connectors 29 are in contact with bottom wall 66 of the metal drum 50. In order to hold the card in its desired position, an elongated U-shaped spring 70 (see in particular the cross-sectional view of FIGS. 10 and 13), presses downwardly on the ground conductors 29 holding them tightly against the bottom wall 66 of the groove in drum 50. The upper end of the spring 70 engages an annular ring 71. There is a spring member 86 and three additional spring members 87 which are located in indents 55 in the inner wall of the body 62. They press against the annular ring 71, to position the ring 71 concentric with the axis of the attenuator. The springs 86 and 87 are identical, except springs 86 must have holes through which the coaxial connectors 10 pass.

At the front end of the drum, there is a plastic element 81*a*, which performs the same function as that of element 81 except it does not have a projection, such as 72, or the function of that projection.

The preferred forms for the trough 56–66 and the card are shown in FIGS. 22 and 23. The card 90 of insulating material has the ground conductor 15 running along its lower middle longitudinal area, and has two ground conductors 91 which are painted on a short portion of the card 90 contiguous with each longitudinal edge, including along both longitudinal side walls. Alternatively all of conductors 15 and 91 may be applied using printed circuit techniques. In this case, the thicknesses of conductors 15 and 91 are the same. The ground conductors 91 rest on the two internal ledges, or steps 92, respectively positioned along the two side walls 56. The two steps 92 position the card 90 and the inner conductor 15 a precise and accurately defined distance from the bottom wall 66 of the longitudinal trough or groove 56–66.

Irrespective of which one of the several cards 13 (or 90) of the attenuator is moved into operating position, the electrical current paths through the device are as follows: The outer conductor of conductor 10 is connected to the cylindrical body member 62 which is part of the body 60. Therefore, the walls 66 and 56 as well as the ground conductors 29, the spring 70, and the annular ring 71 are all part of the outer conductor of the transmission line. The inner conductor of the entire attenuator includes points 23, contact strips 69, contact springs 68 and the inner conductor 15. A resistive layer may be located on the lower face (FIG. 10) of the card 13 between inner conductor 15 and ground conductors 29.

The inner conductor 15 is very accurately spaced above the wall 66 by the thickness of the material forming ground conductor 29. Hence, there is a very accurate and carefully controlled relationship between the inner conductor 15 and the wall 66. Due to the close proximity of these two parts, there is an intense field between the inner conductor 15 and the wall 66. However, in view of the considerable distance between the inner conductor 15 and the spring 70, there is only a small field in the region above the card 13. Therefore, it is unnecessary to provide accurate shape and/or positioning of the spring 70 in order to preserve the broadband characteristics of the attenuator.

If the inner conductor 15 is printed upon the lower face of the dielectric card 13, the thickness of, and dielectric constant of, the dielectric substrate forming the card has minimal effect upon the broadband characteristic of the attenuator.

Moreover, for the reasons stated earlier, the resistive layers on the card should be on its lower face and should include resistive strips 30 closely adjacent the two lateral ends of the card 13.

Moreover, it is desirable that the contact spring 68 (see FIGS. 11, 15 and 16) have the shape shown for reasons now to be described. The drum attenuator of FIG. 6 is capable of receiving cards of identical physical size but having a wide range of dB values. It is desirable that these different cards may readily be plugged into any of the various grooves or troughs 66–56 of FIG. 6. They must have two connecting springs respectively enabling the two ends of the inner conductor 15 to be placed into electrical contact with the contact strips 69

(FIG. 11) which are engaged by contact points 23 of the incoming (or outgoing) coaxial connector 10.

Remembering that the inner conductor 15 is a printed line running longitudinally along the lower face of the dielectric substrate card 13, each contact spring 68 has a U-shaped connecting portion around an end of the card with one leg of the U engaging the printed conductor 15 and the other leg of the U being on the top face of the card, vertically above the leg on the lower face of the card. A contact strip, which is part of 68, extends from the free end of the last-mentioned leg transversely to the card and at an acute angle to said last-mentioned leg, and engages contact strip 69 (see FIG. 11).

The shape of contact spring 68 eliminates inefficient stubs and other problem areas. The current from inner conductor 15 passes around the U-shaped portion of the U and then along the transverse section without disturbing the electromagnetic field of the attenuator.

In view of the fact that a very high degree of accuracy should be maintained between some of the parts, it is highly desirable to minimize the forces created by the detent mechanism. The new detent mechanism of this application accomplishes the above result.

Figure 3:
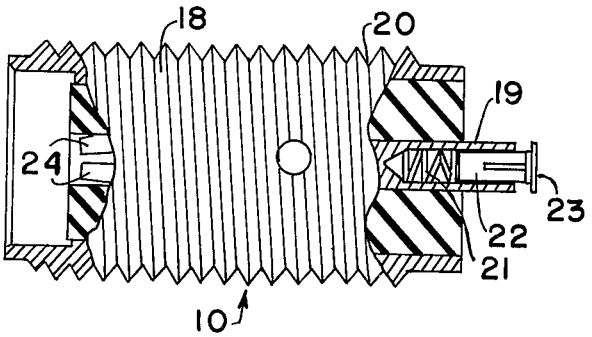
FIG. 3 is a plan view, partially in section of a coaxial line, complete with contact point, used as an input or output for the attenuator.

Projecting to the rear of the drum 50 is a plastic element 81 which is connected for synchronous rotation with body 50 by a pin 83. Plastic projection 81 has a further projection 72 which provides for an annular cavity between its inner surface and the outer surface of shaft 61 (see FIGS. 2 and 3) except for the fact that an indent 73 extends inwardly. The rear cover 63 for the attenuator carries pin 75 which normally rides against the inner surface of projection 72, that is it rides in the cavity between the inner surface of element 72 and the outer surface of shaft 61 (FIGS. 2 and 3).

Since the pin 75 is stationary, it will stop the rotation of the drum 50 when the pin 75 is engaged by the projection 73. Since projection 73 extends inwardly half way between two of the contact elements 69, all 10 (or 11 as the case may be) of the card attenuators may be brought into the operating circuit by rotating the drum 50 from a position where a pin 75 engages one side of the projection 73 to the angular position where that pin engages the other side of the angular projection 73.

The polygon shaped projection 72 has an even number of sides in FIG. 7 because that attenuator employs an even number of steps (card attenuators), in this case ten. When the drum 50 has ten card attenuators, two parallel resilient bars 79 and 80 are employed in a position shown. The bar 79 is held in place since its two free ends are held in notches 76 and its midsection is in face to face contact with one of the sides of the polygon shaped projection 72. Similarly, resilient bar 80 has upper and lower ends respectively in notches 77 and a midsection which engages a face of the polygon opposite to the face engaged by bar 79. In the event that it is desired to substitute an attenuator drum having eleven attenuator cards, in place of the one having ten cards, many of the same parts may still be used. For example, the coaxial connectors 10, the body 60, the cylindrical body element 62, the end plate 63 and the pin 75 may remain exactly the same. The new rotatable drum 50 will in this case have eleven instead of 10 attenuators, and similarly, the projection 72 will have eleven sides instead of 10 sides. In order to accommodate this change, the resilient bar 80 will have its two free ends inserted into two notches 78 so that the midsection of the bar 80 is in face to face contact with one of the faces of the polygon shaped projection 72.

It follows that when the rotatable drum 50 is rotated to any one or more of the predetermined positions at which it connects a card attenuator 13 to the coaxial connectors 10, the resilient bars 79 and 80 provide a simple, inexpensive and reliable detenting operation tending to bias the drum 50 in said positions. In view of the extreme accuracy and long life required in a device such as a step attenuator, it is undesirable to have any wear, deterioation or other such factors which over a period of time might change the characteristics of the attenuator. Life usually must exceed 1 million steps or 100,000 rotations. The polygon shaped projection in combination with the resilient bars 79 and 80 provide a balanced system (when the polygon has an even number of sides) which has small wear. Moreover, the drum 50 may be moved out of one of its detented positions with less torque than is required with most other detent mechanisms. As a result, the forces exerted on the various parts of the device are reduced and the device is, therefore, more reliable over the long term. Moreover, the detent operation does not in any way impair the broadband characteristics of the attenuator, or the impedance presented by any of the cards of the step attenuator.

I claim to have invented:

1. An attenuator comprising:

an elongated insulating card having an inner conductor extending longitudinally along the card, said card having first and second faces, an elongated tubular outer conductor surrounding said card and said inner conductor, said outer conductor having a conductive inner wall, said outer conductor defining first and second cavities extending away from said first and second faces respectively with the first cavity being many times the size of the second cavity and with relatively small electric field intensity as compared with that in the second cavity, said card having at least one side edge extending longitudinally along the card, in contact with the inner wall of the outer conductor and in spaced relation with said inner conductor, and a resistive layer on one face of said card and extending from at least a portion of the inner conductor to the outer conductor, said outer conductor and said card comprising means to accurately position the inner conductor with respect to that portion of the inner wall of the outer conductor which is contiguous with said second cavity and to provide the attenuator with a constant characteristic impedance over a band of frequencies extending from D.C. to at least 2 GHz.

2. An attenuator as defined in claim 1 in which said card is rectangular and has its two longitudinal side edges in engagement with the inner wall of the tubular outer conductor.

3. An attenuator as defined in claim 2 in which said inner conductor extends longitudinally along the card midway between said longitudinal edges.

4. An attenuator as defined in claim 3 in which said card includes two elongated ground conductors respectively extending along said two longitudinal edges of the card, said resistive layer extending from at least a portion of said inner conductor to at least a portion of one of said ground conductors.

5. An attenuator as defined in claim 4 in which said resistive layer is on said second face of said card.

6. An attenuator as defined in claim 5 in which the resistive layer extends from at least a portion of the inner conductor to at least portions of both ground conductors.

7. An attenuator as defined in claim 6 in which the resistive layer is a strip that is adjacent one lateral edge of the card and extends from the inner conductor to both of said ground conductors.

8. An attenuator as defined in claim 6 in which the resistive layer comprises two strips respectively adjacent the two lateral edges of the card, each of the strips extending from the inner conductor to both outer conductors.

9. An attenuator as defined in claim 4 in which the ground conductors comprise spacing means for spacing the card from the inner wall of the tubular outer conductor that is contiguous with said second cavity.

10. An attenuator as defined in claim 9 in which said inner wall of said tubular conductor that is contiguous with said second cavity includes two support portions, said two ground conductors extending away from said card and resting on said support portions to space the card and the inner conductor from the inner wall of the tubular outer conductor that is contiguous with said second cavity.

11. An attenuator as defined in claim 10 in which the portion of the wall of the tubular outer conductor that is contiguous with said first cavity comprises a spring that presses said ground conductors against said support portions.

12. An attenuator as defined in claim 11 in which the cross-section of said spring is generally of U-shape with the free ends of the U pressing said ground conductors against said support portions, an element which is in fixed relation with reference to said support portions and engaged by the base of the U in order to compress the U and press the free ends thereof toward said support portions.

13. An attenuator as defined in claim 1 in which said outer conductor includes a conductive trough, said trough having a bottom wall and two side walls, said trough having ledges extending inwardly from said two side walls and spaced above said bottom wall, said card having first and second longitudinal portions respectively along its longitudinal sides, said first and second longitudinal portions respectively resting on said ledges to define said first cavity between said card and said bottom wall, said inner conductor being spaced from said bottom wall.

14. An attenuator as defined in claim 13 in which at least one of said longitudinal portions comprising a ground conductor, said ground conductor including conducting material on the face of the card that is in contact with said ledges to thus place said ground conductor in conductive contact with one of said ledges, said resistive layer extending from said inner conductor to said ground conductor.

15. An attenuator as defined in claim 13 in which:

each of said longitudinal portions comprising a ground conductor, each of said ground conductors including conducting material on the face of the card that is in contact with said ledges to thus place each ground conductor in conductive contact with its complementary ledge, said resistive layer extending from said inner conductor to both of said ground conductors.

16. An attenuator comprising:

an elongated card of insulating material having an inner conductor extending longitudinally along a first face of said card, said card having a second face on the opposite side of the card from the first face, an elongated tubular outer conductor comprising an elongated first inner wall portion, adjacent said first face of the card, and an elongated second inner wall portion spaced from said second face, spacing means located between said card and said first inner wall portion for accurately spacing said card from said first inner wall portion, said spacing means comprising two ground conductors running along the opposite longitudinal side edges of said card, an element fixed with reference to said first inner wall portion, the portion of said tubular outer conductor which includes said second inner wall portion comprising an elongated spring of U-shaped cross-section having the base of the U engaging said element and the two free ends of the U respectively engaging the two ground conductors to press the latter firmly against the first inner wall portion, the spacing between the inner conductor and the base of said U being many times the space between the inner conductor and said first inner wall portion, said U-shaped spring being elongated so that it extends substantially along the length of said card, and resistive material between said inner and ground conductors to provide the desired attenuation.

17. An attenuator as defined in claim 16 in which said ground conductors are elongated members of U-shaped cross-section with the two legs of each U respectively on opposite sides of the card.

18. An attenuator as defined in claim 17 in which said first inner wall portion has two conducting portions in contact with said two ground conductors and against which said ground conductors are pressed by the legs of said U-shaped spring.

19. An attenuator as defined in claim 16, in which there are in addition to the attenuator of claim 16 a plurality of similar attenuators, the first portions of the outer conductors of all of said attenuators comprising a cylindrical metal drum having an axis and defining, for each attenuator, one longitudinal groove parallel to the axis of the drum and extending inwardly from the outside of the drum, the walls of the longitudinal groove complementary to a given attenuator defining the inner walls of said first portion of the outer conductor of that attenuator.

20. Apparatus as defined in claim 19 having a pair of contacts for each groove respectively adjacent the two ends of the groove, the inner conductor complementary to said groove having two opposing ends respectively connected to the contacts that are adjacent the opposite ends of said groove, one contact of each pair being (a) in a first plane perpendicular to said axis, and (b) adjacent one end of the drum, the other contact of each pair being (a) in another plane perpendicular to said axis, and (b) adjacent the other end of the drum, two coaxial lines each having an inner conductor and an outer conductor, said coaxial lines being in said two planes respectively and along a line that is parallel to said axis, the two coaxial lines having outer conductors connected to said drum, and means for rotating the drum about its axis to bring the two contacts at the opposite ends of said any one of the grooves into contact with the inner conductors of said two coaxial lines respectively.

21. Apparatus as defined in claim 20 in which the fixed elements of each attenuator comprises an annular sleeve concentric with said drum and limiting the outer position of each of said U-shaped springs.

22. Apparatus as defined in claim 21 having an outer metal container having an annular cavity surrounding said sleeve and electrically connected thereto, said container having threaded holes therethrough in said two planes and positioned on said line that is parallel to said axis, the said coaxial lines, having outer threads, and respectively mating with the threads of said two holes.

23. An attenuator comprising an elongated inner conductor, an elongated tubular outer conductor, surrounding the elongated inner conductor, comprising an elongated first inner wall portion and an elongated second inner wall portion, said outer conductor including conducting means electrically connecting said elongated first inner wall portion to said elongated second inner wall portion, resistor means extending from the inner conductor to said conductor means, and means, including an insulating support for said inner conductor, for accurately spacing said inner conductor from said first inner wall portion, and positioning the inner conductor to concentrate the electric field between the inner conductor and said first inner wall portion.

24. An attenuator as defined in claim 23 in which said insulating support is a card of insulating material extending between said inner conductor and said connector means, said resistor means being a layer of resistive material on said card and extending between said inner conductor and said conductor means.

25. An attenuator as defined in claim 24 in which the cross-sectional area between the card and the elongated first inner wall portion is small as compared to the cross-sectional area between said card and said elongated second inner wall conductor.

26. An attenuator as defined in claim 25 in which the card has a first face that faces the elongated first inner wall portion and a second face that faces the elongated second inner wall portion, said layer of resistive material being on said first face of said card.

27. In an attenuator, a cylindrical drum of conducting material having a central axis about which the drum is rotatable, said drum having a plurality of longitudinal grooves parallel to said axis and extending inward from the periphery of the drum, attenuator means for each groove, each attenuator means comprising an elongated inner conductor having first and second ends and means for supporting the inner conductor adjacent the wall of the groove so that such wall will constitute part of an outer conductor, resistive means connected between said inner conductor and the outer conductor, and a conductive covering for the groove to complete the outer conductor so that the outer conductor extends completely around both the inner conductor and the resistive means, and stationary switching means, having first and second inner-conductor output leads, adjacent the periphery of the drum for connecting said first and second output leads to the first and second ends of any particular said inner conductor upon rotation of said drum to select said particular inner conductor.

28. In an attenuator as defined in claim 27 each said attenuator means comprising an elongated card having said inner conductor extending along the card in spaced relation to the elongated side edges of the card.

29. In an attenuator as defined in claim 27, said resistive means extending from said inner conductor to at least one of the longitudinal side edges of the card.

30. In an attenuator as defined in claim 28, said card having an elongated ground conductor running along at least one of the elongated side edges of the card, said resistive means extending from the inner conductor to said ground conductor.

31. In an attenuator as defined in claim 30, said resistive means including at least one strip of resistive material extending from the inner conductor to the ground conductor adjacent one lateral end of the card, said strip being narrow in width along the length of the card as compared to the length of the card.

32. In an attenuator as defined in claim 31 having an additional resistive strip between the inner conductor and the ground conductor adjacent the lateral end of the card opposite the first-named lateral end, said additional resistive strip being narrow in width along the length of the card as compared to the length of the card.

33. In an attenuator as defined in claim 28, said card having ground conductors running along both the longitudinal side edges of said card, each said groove being wider than said card and having a bottom wall and upstanding walls, said ground conductors of a given card, resting on said bottom wall of the groove which is complementary to said card, and constituting spacing means for spacing the card from said bottom wall.

34. In an attenuator as defined in claim 33, said resistive means of each attenuator means being located on the face of the card closest to said ground wall.

35. In an attenuator as defined in claim 34, said resistive means of each attenuator means comprising at least one layer of resistive material connecting the inner conductor with both ground conductors.

36. In an attenuator as defined in claim 33, the spacing between said inner conductor and said bottom wall being small as compared to the distance between said inner conductor and said conductive covering to thereby concentrate the field between said inner conductor and said bottom wall.

37. In an attenuator as defined in claim 36, said conductive covering comprising spring means for pressing said ground conductors against said bottom wall to provide accurate spacing between the inner conductor and said bottom wall.

38. An attenuator comprising: socket means into which any one of a plurality of attenuator cards may be inserted and removed;

an attenuator card including means for permitting insertion of said card in said socket means and for removal of said card from said socket means, said attenuator card having a face and comprising:

a. an elongated sheet having longitudinal sides and lateral ends, b. an inner conductor extending longitudinally along said face of said card from one lateral end of the sheet to the other, c. a ground conductor along at least one of said longitudinal sides, d. first and second layers of resistance material adjacent said first and second lateral ends, each said layer connecting the inner conductor to the ground conductor, each of said layers being narrow so that its width is many times smaller than the length of the sheet, e. first and second contact elements respectively at the opposing ends of said inner conductor;

said socket means including first and second contacts respectively positioned to engage said first and second contact elements of said inner conductor when said card is inserted in said socket means and also including contact means for making contact with said ground conductor when said card is inserted in said socket means.

39. An attenuator as defined in claim 38 in which there are a plurality of attenuator cards having different attenuation values, each such card having a face and comprising means for permitting insertion of said card in said socket means and for removal of said card from said socket means, and each said card having said elements (a) to (e) inclusive.

40. A card for an attenuator comprising a sheet of insulating material having first and second faces, a side, and two ends, an inner conductor extending along a first face of said sheet in spaced relation to said side, and passing along the full length of the sheet, from one of said ends to the other, a ground conductor extending along said side, and first and second layers of resistance material adjacent said first and second ends respectively each said layer connecting the inner conductor to the ground conductor, each of the layers being narrow so that its width is many times smaller than the length of said sheet, the distance of each layer from its respective end being many times smaller than the length of the sheet.

41. A transmission line comprising a card having first and second faces and having an inner conductor extending along the second face of, and to one end of, the card, connecting means for making connection to said inner conductor comprising a U-shaped element, said U extending around said end with a first leg of the U extending along and being electrically in contact with the inner conductor along said second face, said first leg terminating in a free end, and the second leg of the U extending along said first face for a limited distance, said connecting means including a conducting portion beginning at the free end of said second leg and extending transversely away from, and at an acute angle to, said second leg, and an outer conductor extending around the inner conductor and spaced from said connecting means so that said connecting means operates at the potential of the inner conductor.

42. A transmission line as defined in claim 41 in which said conducting portion comprises a contact spring.

43. A transmission line as defined in claim 42 including:

mounting means for supporting said card and moving it from one position to another, and stationary contact means engaged by said contact spring in at least one of said positions.

44. A transmission line as defined in claim 42 including: mounting means for supporting said card and moving it from first position to a second position and separate stationary contacts which respectively are engaged by said contact spring in said first and second positions.

45. A transmission line as defined in claim 42, including:

contact means comprising first and second contacts, and means operable to move said contact means relative to said card to select which of said first and second contacts is engaged by said contact spring.

46. A transmission line as defined in claim 41 in which said inner conductor extends from one end of said card to the other end of said card and has one of said connecting means at each end of the card.

47. A transmission line as defined in claim 41 in which said card has a ground conductor extending along one edge of the card in spaced relation to the inner conductor, and resistive material between the inner conductor and the ground conductor to form an attenuator.

48. A transmission line as defined in claim 41 in which said card is rectangular in shape, ground conductors extending along both longitudinal edges of the card, the inner conductor extending along the card parallel to both ground conductors, and resistive material extending between the inner conductor and at least one of the ground conductors to form an attenuator.

49. A transmission line as defined in claim 48 in which the resistive material extends between the inner conductor and both ground conductors.

50. A card for an attenuator comprising a rectangular sheet of insulating material having two longitudinal sides and two lateral ends, an inner conductor extending longitudinally along one face of said sheet spaced from both of said longitudinal sides, one end of said inner conductor extending from said one face around one lateral end of said sheet and then having a section extending along the other face of said sheet for a short distance as compared to the length of the sheet and then extending away from said other face at an acute angle to said section to form a contact element.

51. A card for an attenuator as defined in claim 50 in which said sheet has a ground conductor along one of said longitudinal sides, and resistance material between said inner conductor and said ground conductor.

52. A card for an attenuator as defined in claim 50 in which said sheet has ground conductors along both of said longitudinal sides, said ground conductors extending away from said one face of the sheet a greater distance than the inner conductor extends away from the face of the sheet, and layer means of resistance material on said one face for interconnecting the inner conductor to said ground conductors.

53. A card for an attenuator comprising a rectangular sheet of insulating material having first and second faces, two longitudinal sides, and two lateral ends, a first ground conductor extending along one of said longitudinal sides, resistive means for providing the card with an attenuation value in excess of 10 dB with a substantially flat frequency response from DC to 26 GHz comprising an inner conductor extending along a first face of the card and passing from one of said ends to the other, said inner conductor being of substantially constant cross-section along the card so that it is non-reactive to current passing through the same from one end of the card to the other end, and first and second layers of resistance material adjacent said first and second lateral ends, each said layer connecting the inner conductor to the ground conductor, each of the layers being narrow so that its width is many times smaller than the length of said sheet, the distance of each layer from its respective lateral end being many times smaller than the length of the card.

54. A card for an attenuator as defined in claim 53 having additional layers of resistance material between said inner conductor and said ground conductor.

55. A card adapted to be mounted on a support, for an attenuator comprising a rectangular sheet of insulating material having two longitudinal side walls and two lateral end walls, said sheet having first and second faces, ground conductors extending along said longitudinal side walls and also extending away from said first face to form spacing means for supporting the sheet above said support, an inner conductor extending along said first face but extending therefrom a smaller distance than the ground conductors extend therefrom, said inner conductor extending around one of said lateral end walls to said second face and then extending along said second face for a distance which is short compared to the length of the sheet to thereby form a section of the inner conductor and then extending transversely away from the sheet at an acute angle to said section to thereby form a contact strip, said inner conductor also extending around the other lateral end wall to said second face and then extending along said second face for a distance which is short compared to the length of the sheet to thereby form another section of the inner conductor and then extending transversely away from the sheet at an acute angle to said another section to thereby form a second contact strip, and resistive layer means on said first face interconnecting the inner conductor and at least one ground conductor.

56. A card, adapted to be mounted on a support, for an attenuator, as defined in claim 55, comprising said resistive layer comprising two strips respectively adjacent said lateral ends of the sheet, each resistive layer extending from the inner conductor to at least one ground conductor and its width being small compared to the length of the card.

57. A card for an attenuator comprising a rectangular dielectric substrate having a ground conductor extending along at least one longitudinal side wall and an inner conductor on one face of the substrate running parallel to the ground conductor, and a resistive layer on said face extending from the inner to the ground conductor, said layer having a width many times smaller than the length of the substrate, said layer being in a closely spaced relation to one lateral end of the substrate.

58. A card for an attenuator as defined in claim 57 comprising a second resistive layer on said face extending from the inner to the ground conductor, said layer having a width many times smaller than the length of the substrate and being in closely spaced relation to the other lateral end of the substrate.

59. A card for an attenuator as defined in claim 58 having a ground conductor along the other longitudinal side wall, said narrow layers each extending from said inner conductor to both of said ground conductors.

60. A card for an attenuator comprising a sheet of insulating material having first and second faces, at least one side, and two ends, an inner conductor extending along a first face of said sheet in spaced relation to said side and passing along the full length of the sheet, from one of said ends to the other, a ground conductor extending along said side, and a layer of resistance material adjacent one of said ends, said layer connecting the inner conductor to the ground conductor, said layer being narrow so that its width is many times smaller than the length of said sheet, the distance of said layer from its adjacent end being many times smaller than the length of the sheet.

* * * * *

UNITED STATES PATENT OFFICE

CERTIFICATE OF CORRECTION

Patent No. 4,107,633 Dated Aug. 15, 1978

Inventor(s) Ronald C. SCALETTA

It is certified that error appears in the above-identified patent and that said Letters Patent are hereby corrected as shown below:

At the end of the first sentence of the abstract "for example 4 GHz" was omitted.

In column 6, line 62, "card" should be "cards".

In column 7, line 5, "frequency" should be "frequently".

Signed and Sealed this

*Twenty-fourth* Day of *April 1979*

[SEAL]

*Attest:*

RUTH C. MASON
*Attesting Officer*

DONALD W. BANNER
*Commissioner of Patents and Trademarks*